United States Patent [19]

de Gunzburg

[11] 4,327,513

[45] May 4, 1982

[54] ILLUMINATED OUTDOOR SIGN AND HOUSING

[75] Inventor: Melinda de Gunzburg, Beverly Hills, Calif.

[73] Assignee: Pana-Plex Company, Inc., Sherman Oaks, Calif.

[21] Appl. No.: 113,997

[22] Filed: Jan. 21, 1980

[51] Int. Cl.[3] ..... G09F 13/00

[52] U.S. Cl. ..... 40/572

[58] Field of Search ..... 40/574, 572, 564, 156, 40/606

[56] References Cited

U.S. PATENT DOCUMENTS

| | | | |
|---|---|---|---|
| 1,475,977 | 12/1923 | West | 40/564 |
| 3,593,448 | 7/1971 | Schoepf et al. | 40/574 |
| 3,848,349 | 11/1974 | Olsen | 40/574 |
| 4,007,552 | 2/1977 | Brooks | 40/606 |
| 4,194,312 | 3/1980 | Connors et al. | 40/156 |

FOREIGN PATENT DOCUMENTS

| | | | |
|---|---|---|---|
| 909506 | 9/1972 | Canada | 40/564 |

*Primary Examiner*—Gene Mancene
*Assistant Examiner*—Wenceslao J. Contreras
*Attorney, Agent, or Firm*—Warren T. Jessup

[57] ABSTRACT

An outdoor sign and housing assembly is provided which is formed of aluminum extrusions, or the like, and which define, in the embodiment to be described, a housing for a plurality of illuminating elements, such as fluorescent lamps, and their associated ballasts and other electrical components; and which also form one or two frames which may be hinged to one or two sides of the housing, and which are constructed to support either a rigid or flexible translucent sign. The flexible sign is supported on its frame by a plurality of specially constructed clamps, and a special tool is provided for tensioning the flexible sign into a taut condition on the frame, after which the clamps are applied. The frames, and the signs supported thereon, may be individually swung open about a hinge axis to permit access to the interior of the housing, and may be individually removable to facilitate the installation of the signs on the frames and of the internal components in the housing.

20 Claims, 16 Drawing Figures

ILLUMINATED OUTDOOR SIGN AND HOUSING

BACKGROUND

Internally illuminated outdoor signs are known and are employed for a wide variety of purposes. Such signs usually take the form of a box-like housing structure with one or both sides constituting frames for translucent sign display panels. Fluorescent lamps are mounted within the interior of the sign, and these are used to illuminate the translucent display panels. The peripheral frame surrounding each of the display panels is mounted to the corresponding side of the housing, and the frame supplies the necessary structural strength to the display panel. The box-like housing provides an enclosure for the fluorescent lamps which illuminate the display panels, and it also provides an enclosure for the electrical wiring and other components associated with the lamps.

Aluminum extrusions of various shapes and sizes are commonly employed in the prior art to construct outdoor signs of the type referred to in the preceding paragraph, such a construction being described, for example, in U.S. Pat. Nos. 3,235,989 and 4,007,552. A principal objective of the present invention is to provide an outdoor sign which is constructed of aluminum extrusions, or other appropriate material, and which is particularly conceived to overcome problems encountered in the manufacture and use of the prior art assemblies.

One feature of the sign of the present invention lies in the attachment of the frames of the display panels to the housing portion of the assembly. In accordance with the invention, each such frame is hinged to the housing in such a manner as to enable each display panel to be opened to permit access to the interior of the housing without the need for hand holes which have a tendency to leak light and moisture; and also the hinge construction is such that each display panel may be removed from the housing for the purposes set forth above.

Another feature of the invention lies in the construction of the housing itself, and of the frames for the display panels which are hinged to the housing, which construction permits flexible sign material forming the display panel to be clamped and held in a taut condition on the frame without any tendency to bow the frame.

Other features of the assembly of the invention include complete flexibility for either single-faced or double-faced signs, and which permits the use of either rigid translucent sign material, such as Plexiglass or an acrylic plastic for the display panels, or flexible translucent sign material such as the material marketed by the 3M Company under the trademark "Panaflex".

Further features of the invention include the fact that the sign can be economically assembled to any desired height or width usually without welding, without exterior screws, and with a minimal number of extrusions, and with many of the extrusions used in the assembly having the same shape to facilitate the extrusion process.

SUMMARY

The invention provides an outdoor illuminated sign housing and frame assembly which permits the ultimate in versatility with a minimum of components. The assembly includes display panels which can accomodate either rigid and flexible translucent sign materials, and each unit may be constructed to have one or two such display panels which are supported on the housing by hidden hinges. The hinges lock automatically when the corresponding panels are opened to a 30° position, and serve to retain the panels on the housing when they are in a closed position or when they are in a 30° open position. However, the hinges are constructed to free the panels and permit them to be lifted individually off the housing when either panel is opened to an intermediate angular position between 15° and 30°. The flexible sign material is supported on its frame by means of clamps, as mentioned above, which permit the material to be tensioned to a taut condition. The frames of the display panels are constructed to wedge with corresponding parts in the housing when closed, to obviate any tendency for the frames to bow, and to hold the flexible sign material in a taut condition. The assembly of the invention is constructed of a minimum of simple parts, and it may be made to any practical desired height or width, as mentioned above. The housing and the display panels are all formed of interlocking extrusions, which are constructed, as will be described, to provide adequate strength to the display panel frames to carry the rigid sign material or the tensioned flexible sign material.

DETAILED DESCRIPTION OF THE PREFERRED EMBODIMENT

Figure 1:
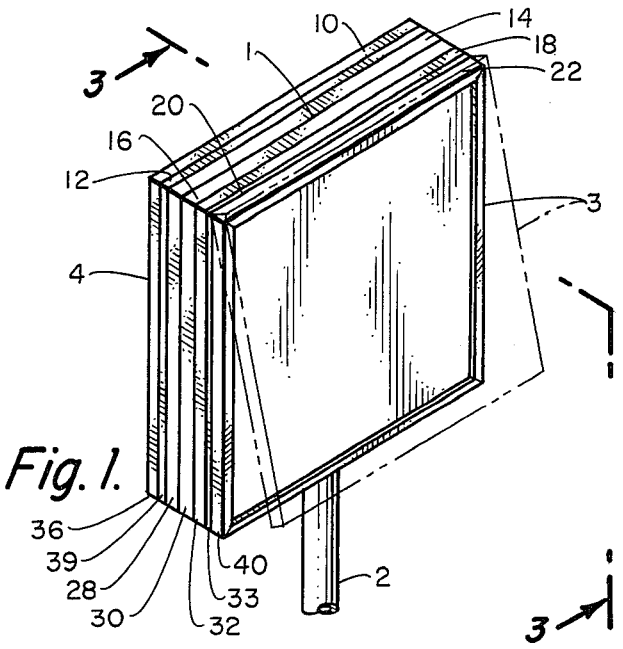
FIG. 1 is a perspective representation of a sign constructed in accordance with the present invention.

The assembly of the invention, as shown in FIG. 1, includes a housing 1 formed of a plurality of aluminum extrusions which are attached to one another by internal tongue-and-groove type couplings and associated screws, so that the outer surfaces of the extrusions are disposed in coplanar relationship, as shown in FIG. 1.

The housing includes a pair of display panels 3 and 4 which are hinged to opposite sides of the housing. If desired, a single display panel hinged to one side of the housing may be used. The assembly is mounted on an appropriate post 2.

Figure 2:
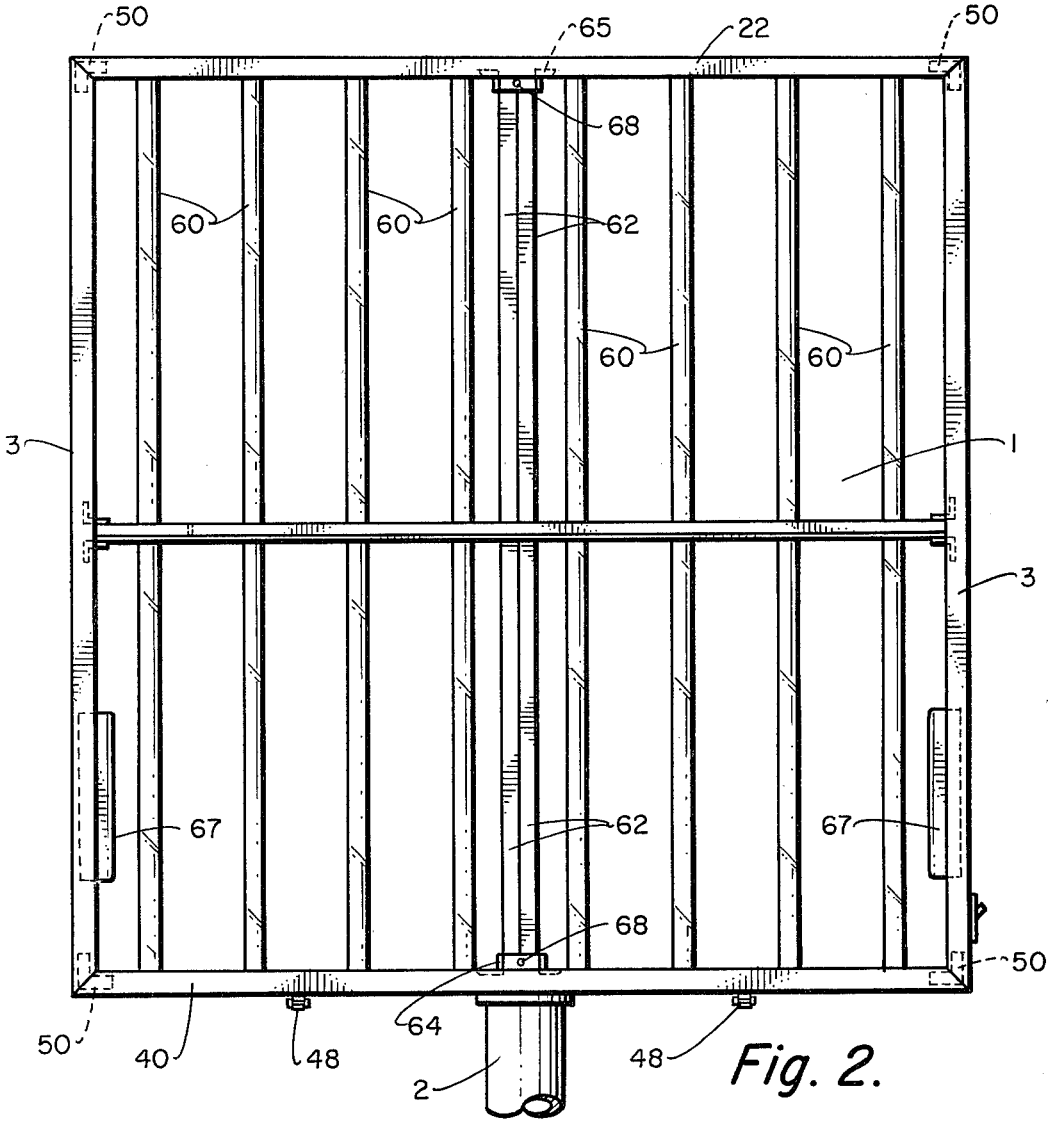
FIG. 2 is a side or face elevation of the sign of FIG. 1, on an enlarged scale; the translucent sign has been removed for clarity.

FIG. 2 is a face view of the assembly of FIG. 1, as noted above, on an enlarged scale with respect to FIG. 1. The translucent sign has been removed for clarity to show mounting of housing 1 and the fluorescent lamps.

Figure 3:
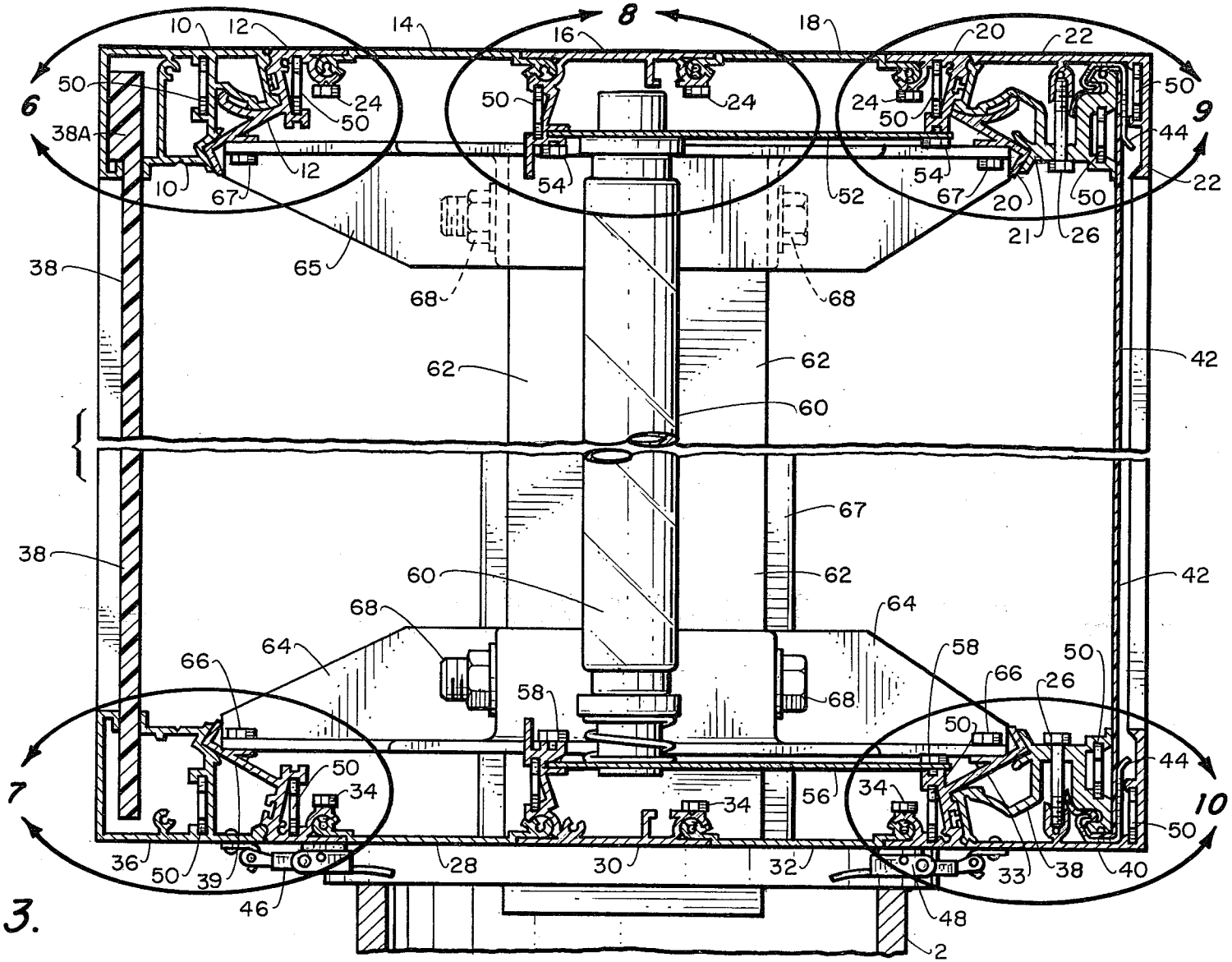
FIG. 3 is a sectional view of the sign of FIG. 1 taken along the line 3—3 of FIG. 1, on an enlarged scale with respect to the view of FIG. 1.

The housing, as shown in FIG. 3, has a top formed of a plurality of aluminum extrusions 12, 14, 16, 18 and 20, of which extrusions 14 and 18 have the same shape. As illustrated, the extrusions are wedged together with their outer surfaces in coplanar relationship by tongue-and-groove type couplings which are held together by internal screws, such as internal screw 24. First and second display panels are hinged to the opposite sides of the housing 1. The first display panel includes an aluminum extrusion 10 which forms an upper beam, and which is hinged to extrusion 12 of the housing. The second display panel includes an aluminum extrusion 21 which forms an upper beam, and which is hinged to extrusion 20 of the housing. The second display panel also includes an aluminum extrusion 22 which is attached to extrusion 21 by bolts, such as bolt 26.

The bottom of the housing in FIG. 3 is formed of a plurality of extrusions 39, 28, 30, 32 and 33, which are wedged together with their outer surfaces in coplanar relationship by tongue-and-groove type coupling portions and which are held together by screws, such as internal screws 34.

Figure 12:
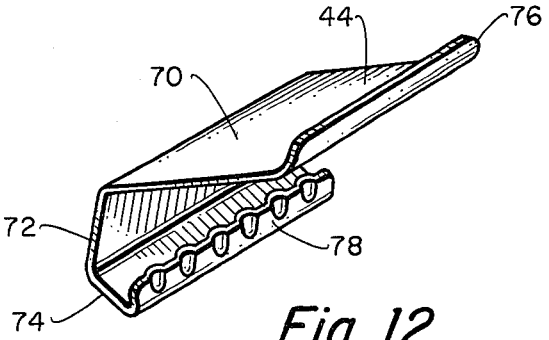
FIG. 12 is a perspective representation of a clip, a number of which are used to hold a flexible sign in a taut condition in its display frame.

The first display panel also includes an aluminum extrusion 36 which forms its lower beam. As shown in FIG. 3, a rigid sign 38 is supported in the first display panel to the left of FIG. 3 by the upper beam 10, and it extends into a slot in the lower beam 36. The sign 38 is formed of appropriate translucent or transparent rigid material such as Plexiglass or an acrylic plastic. The second display panel includes an aluminum extrusion 38 which forms its lower beam, and which is similar in shape to extrusion 21. The second display panel also includes an aluminum extrusion 40 which is similar in shape to extrusion 22. Extrusion 40 is secured to extrusion 38 by bolts, such as bolt 26. A flexible translucent sign 42 is stretched between the top and bottom beams of the second display panel and is held taut by clips, such as clips 44 (FIG. 12). The flexible sign 42 may be formed of any appropriate flexible translucent material, such as "Panaflex", as mentioned above.

The left-hand display panel in FIG. 3 is held in the closed position by latches, such as latch 46; and the right-hand display panel is held in its closed position by latches, such as latch 48. The latches are of the type which draw the corresponding display panels tightly into their closed positions with respect to the housing 1.

Figure 11:
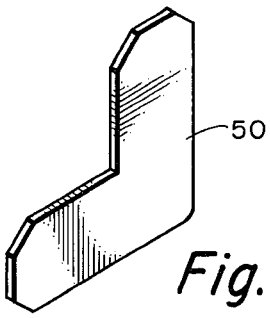
FIG. 11 is a perspective representation of a reinforcing and aligning member, a number of which are used throughout the sign assembly.

Corner aligning members 50 are inserted into the various extrusions, as shown in FIG. 3. The shape of the reinforcing members is shown in FIG. 11.

A first platform 52 is received in slots in extrusions 16 and 20 and is retained by screws 54; and a second platform 56 is supported in a slot in extrusion 30, and is mounted on an extrusion 33 by screws, such as screw 58. Platforms 52 and 56 support sockets for a number of fluorescent lamps, such as lamp 60.

An internal post 62 extends between the bottom and top of the housing of FIG. 3 for strengthening purposes. In addition, a strengthening bracket 64 is attached to extrusions 39 and 33 by screws, such as screw 66; and a similar strengthening bracket 65 is attached to extrusions 12 and 20 by screws, such as screw 67. The brackets 64 and 65 are also attached to post 62 by bolts 68.

A ballast unit for the fluorescent lamps 60 is mounted in the housing. Electric wires connecting the ballast to the fluorescent lamp sockets, and other electrical components and connectors (not shown) are also mounted within the housing.

Figure 5:
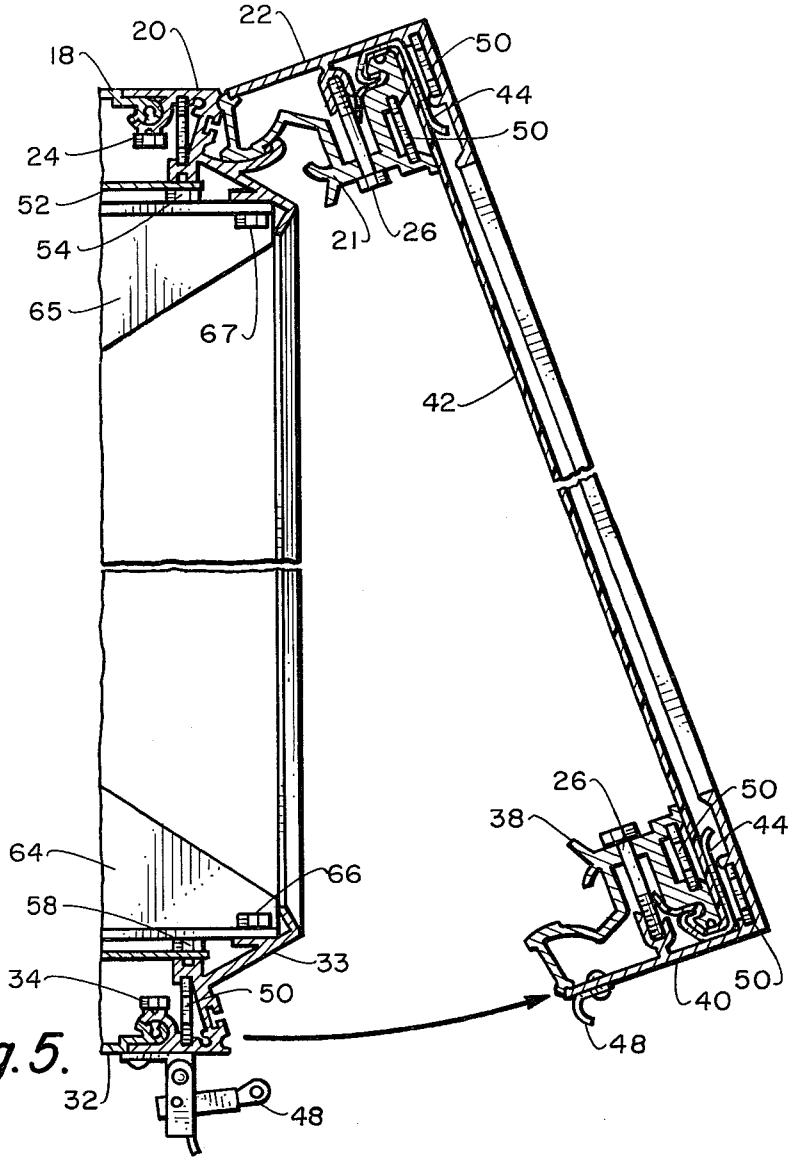
FIG. 5 is a sectional view of the other side of the assembly of FIG. 3, with another display panel associated with the sign in an open condition, whereas the view in FIG. 3 shows the corresponding display panel in a closed position.
Figure 4:
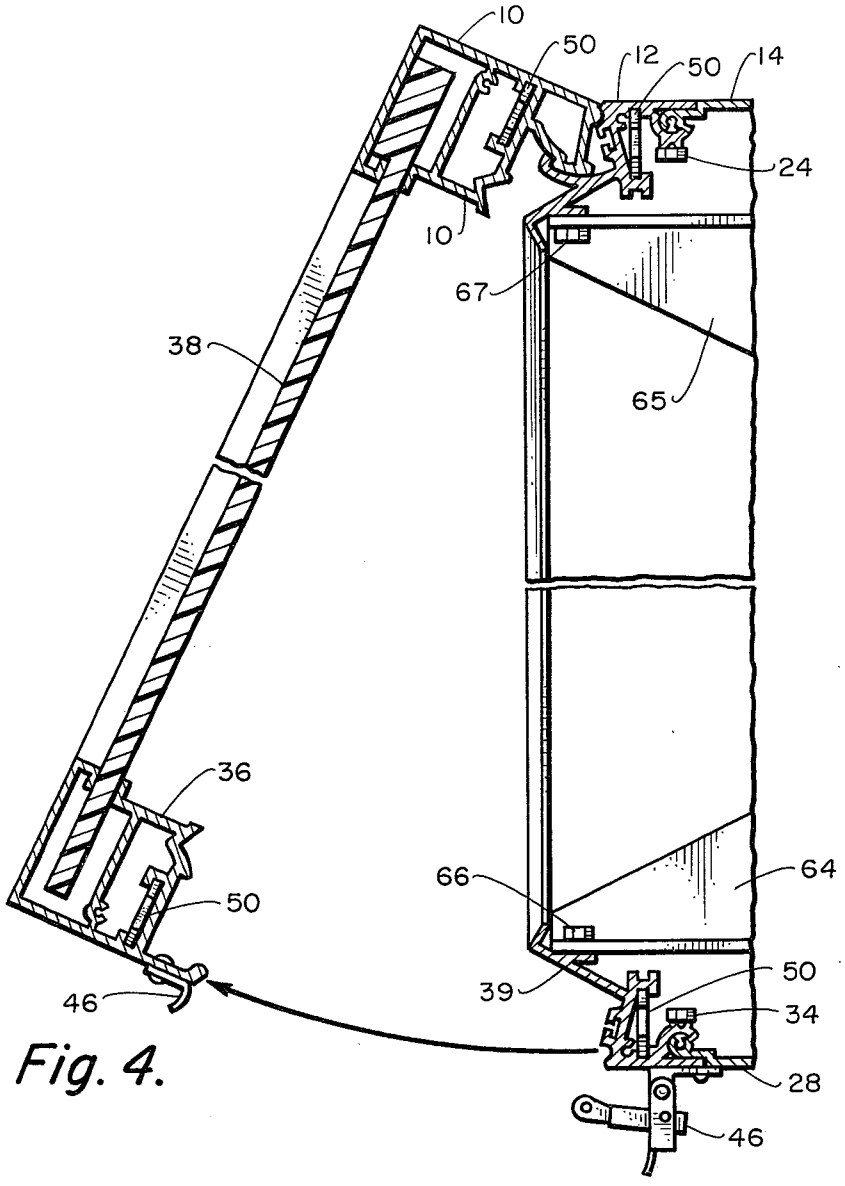
FIG. 4 is a sectional view of one side of the sign of FIG. 1, similar to FIG. 3, but with a display panel in an open condition, whereas in FIG. 3 the display panels are in a closed condition.

As mentioned above, FIG. 3 shows the display panels of the assembly in closed positions, whereas FIGS. 4 and 5 show the display panels in an open position.

In FIG. 4, the left-hand display panel is swung open 30° to permit access to the interior of the housing, and the panel is locked in that position and cannot be removed from the housing because of the configuration of extrusions 10 and 12. However, if the display panel is turned inwardly to a 15° position, the configuration of extrusions 10 and 12 is such that the display panel may be lifted out of and removed from the housing.

In FIG. 5 the right-hand display panel is turned outwardly to a 15° position at which the panel can be lifted up and removed from the housing. However, if the latter display panel were turned outwardly to a 30° position it would be locked in that position because of the configuration of extrusions 20 and 22.

Figure 6:
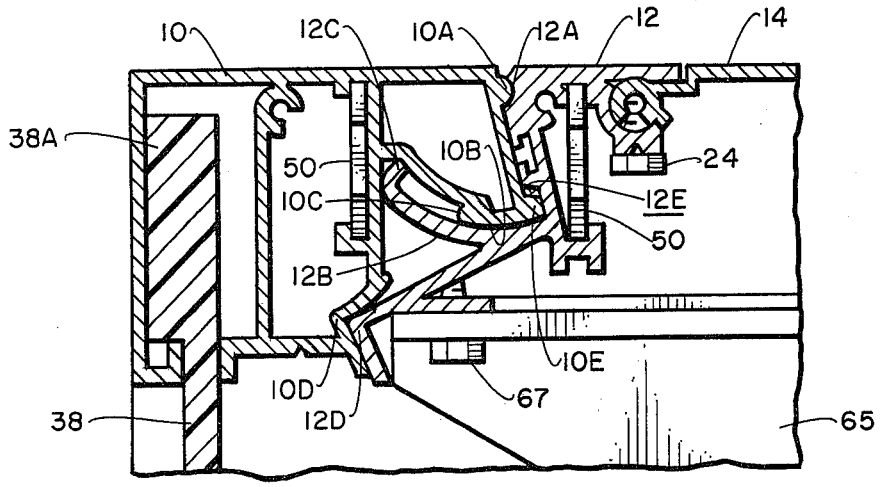
FIGS. 6–10 are enlarged detailed views of certain designated portions of the sign of FIG. 3.

FIG. 6 is an enlarged view of the upper left-hand corner of the assembly of FIG. 3, and shows details of extrusions 10, 12 and 14. It will be observed that extrusion 12 has a longitudinal arcuately shaped groove 12A extending along its length, and an arcuately shaped flange 12B which is centered on the axis of groove 12A, and which has a concave surface facing the groove. Extrusion 10, on the other hand, has an arcuate boss 10A which fits into groove 12A and which turns about the axis of the groove, so that the groove and boss form a hinge. The extrusion 10 also has a flange 10B which is centered in the axis of boss 10A and which has a convex surface that slides along the concave surface of flange 12B as the display panel is turned about the axis of groove 12A. Flange 10B has a shoulder 10C which is received under a lip 12C of extrusion 10 when the display panel is turned outwardly to a 30° position, thereby locking the panel in the housing. However, when the panel is turned, for example, to a 30° position, the extrusion 10 may be lifted out of extrusion 12, and the panel may be removed from the housing.

When the panel is closed, portions 10D and 12D of extrusion 10 and 12 wedge into one another, as shown in FIG. 6 so that the housing extrusions may reinforce the extrusions forming the frame of the display panel, although such reinforcement is not necessary when a rigid sign, such as sign 38 is mounted in the display panel, because normally such a sign does not place undue strain on the extrusions forming the frame of the panel, unless it is unduly heavy. A protuberance 10E of extrusion 10 is received in a pocket 12E of extrusion 12 when the display panel is closed to lock the panel in the housing. The rigid sign 38 is received in a slot in extrusion 10, and it is supported in the display panel by an enlarged end portion 38A.

Figure 7:
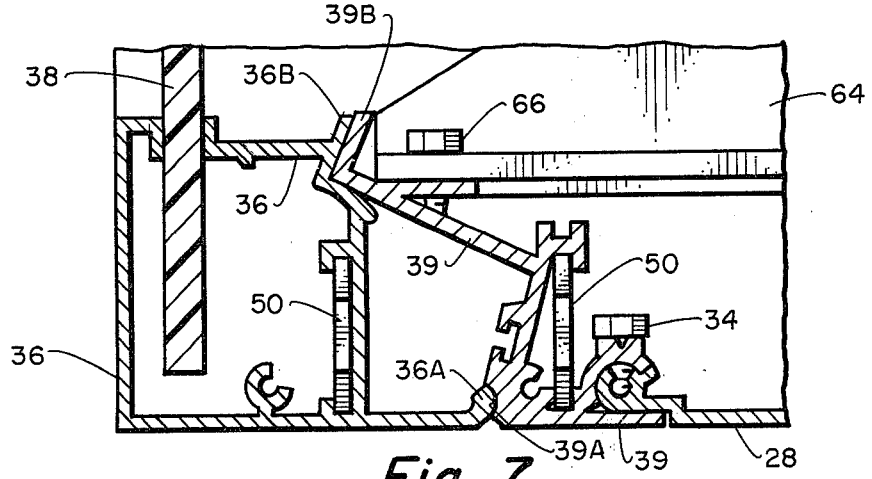

The lower left-hand corner of the assembly of FIG. 3 is shown on an enlarged scale in FIG. 7. It will be seen that the rigid sign 38 is received in a slot in extrusion 36. Extrusion 10 (FIG. 6) and extrusion 36 (FIG. 7) form a frame for the left-hand sign 38.

Figure 8:
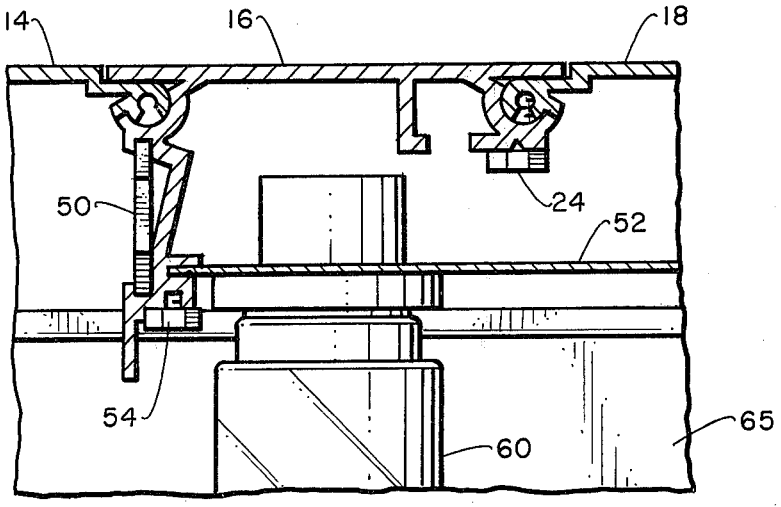

The central upper portion of the assembly of FIG. 3 is shown on an enlarged scale in FIG. 8. FIG. 8 illustrates clearly how platform 52 is received in a slot in extrusion 16 and is supported thereby. The views of FIGS. 6, 7 and 8 also show clearly how the adjacent extrusions are wedged into one another by internal tongue and joint portions formed on the various extrusions.

The edge 36A of extrusion 36 is received in a notch 39A of extrusion 39 in sealing relationship when the left-hand display panel is closed. Also, portion 39B of extrusion 39 is wedged into portion 36B of extrusion 36 (FIG. 7) when the left-hand panel is closed, to relieve some of the strain from the lower extrusion 36.

Figure 9:
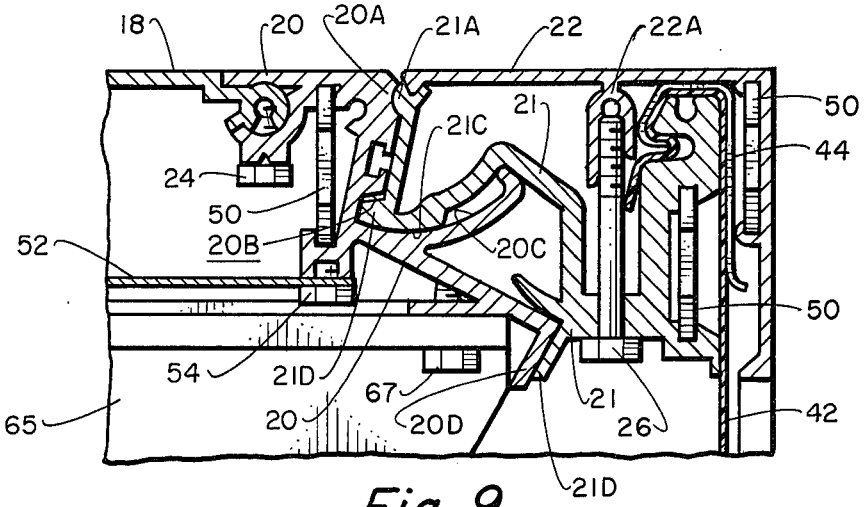

The upper right-hand corner of the assembly in FIG. 3 is shown on an enlarged scale in FIG. 9. The enlarged view of FIG. 9 clearly shows how extrusions 22 and 21 are held together by screws, such as screw 26, which are threaded into sockets, such as socket 22A in extrusion 22. Extrusion 22 forms a frame for the right-hand display panel, together with extrusion 40. It should be noted that extrusions 22 and 40 have the same shape. Also, extrusion 20 has a longitudinal groove 20A which receives a boss 21A of extrusion 21 and which constitutes the hinge axis of the right-hand display panel. Extrusion 20 also has a flange portion which provides a concave surface 20C on which convex surface 21C of extrusion 21 slides as the right-hand display panel is turned about the hinge axis. Also, extrusion 21 has a protuberance 21D which is received in a notch 20B in extrusion 20 when the panel is closed, as shown in FIG. 9, to lock the panel to the housing.

The right-hand end of the surface 21C is received in a mating surface at the end of the flange of extrusion 20 to lock the right-hand display panel to the housing when the panel is opened to its 30° position. However, at intermediate angular positions the right-hand panel may be lifted out of the housing. Also, extrusion 20 has an angled portion 20D which receives an angled portion 21D of extrusion 21 in a wedged relationship to tension the flexible sign 42 when the display panel is closed and latched, and which serves to relieve some of the strain from the extrusion 22 or the frame of the display panel.

Figure 10:
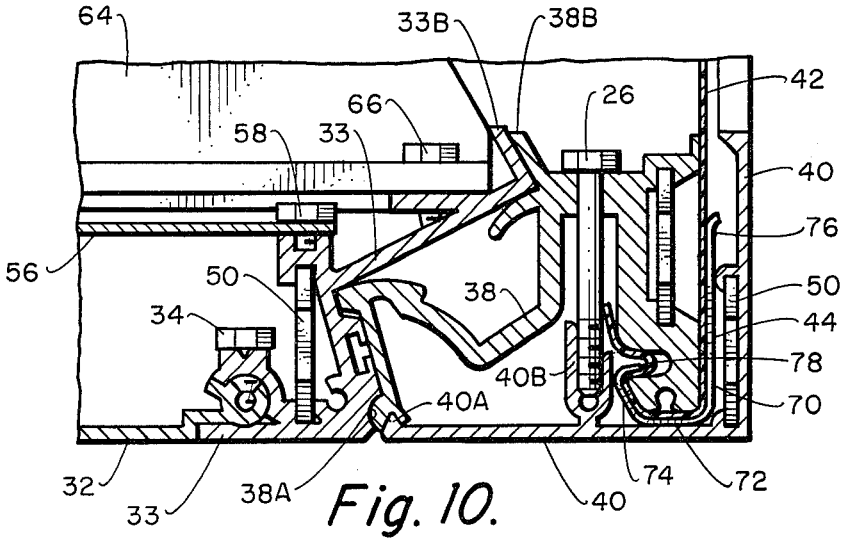

The lower right-hand corner of the assembly of FIG. 3 is shown on an enlarged scale in FIG. 10. In the closed position of the right-hand display panel, extrusion 40 has an edge 40A which is received in a notch 38A of extrusion 38 in sealing relationship. Also, the portion 33B of extrusion 33 is received in sealing relationship by the portion 38B of extrusion 38. It is to be noted that extrusions 38 and 21 have the same shape. It should also be noted that screws, such as the screw 26, are received in threaded sockets, such as socket 40B, in extrusion 40.

Figure 13:
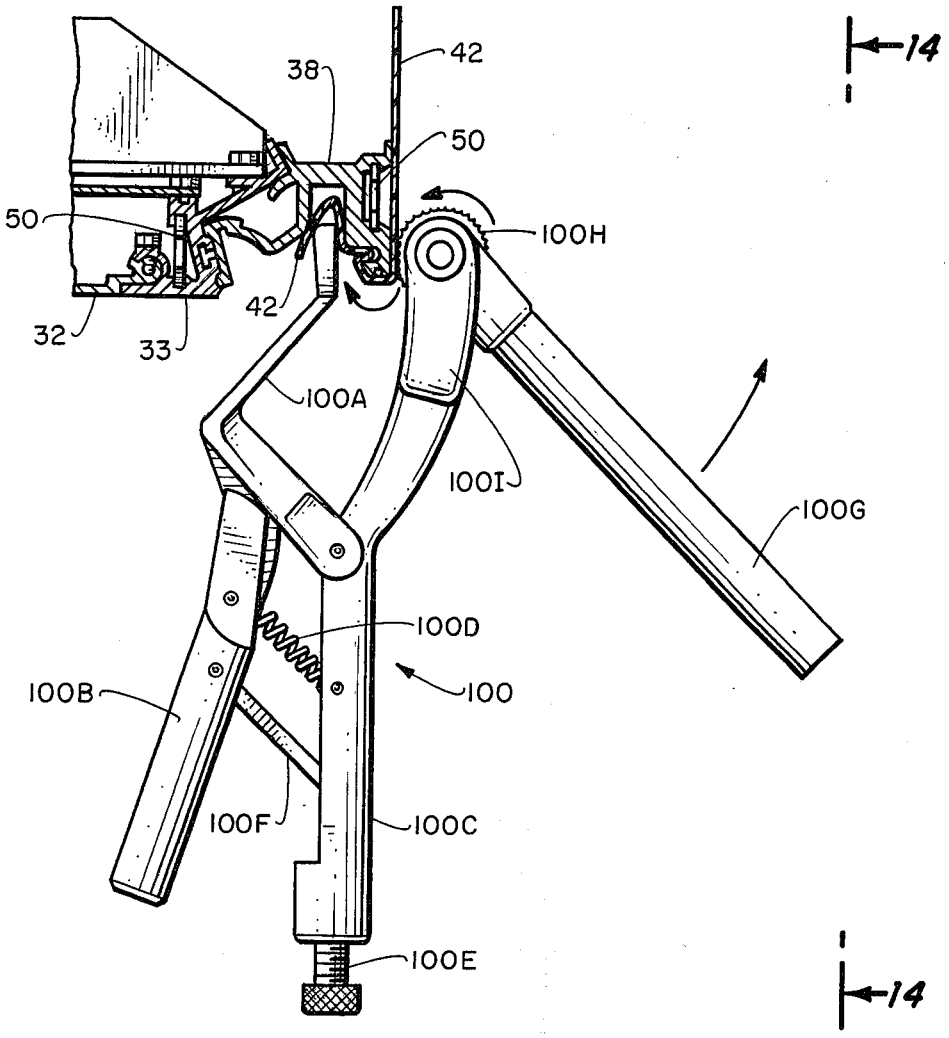
FIG. 13 is a side view of a special tool which is used to draw a flexible sign into a taut condition on the frame of its corresponding display panel prior to clamping the sign by clamps such as shown in FIG. 12.
Figure 14:
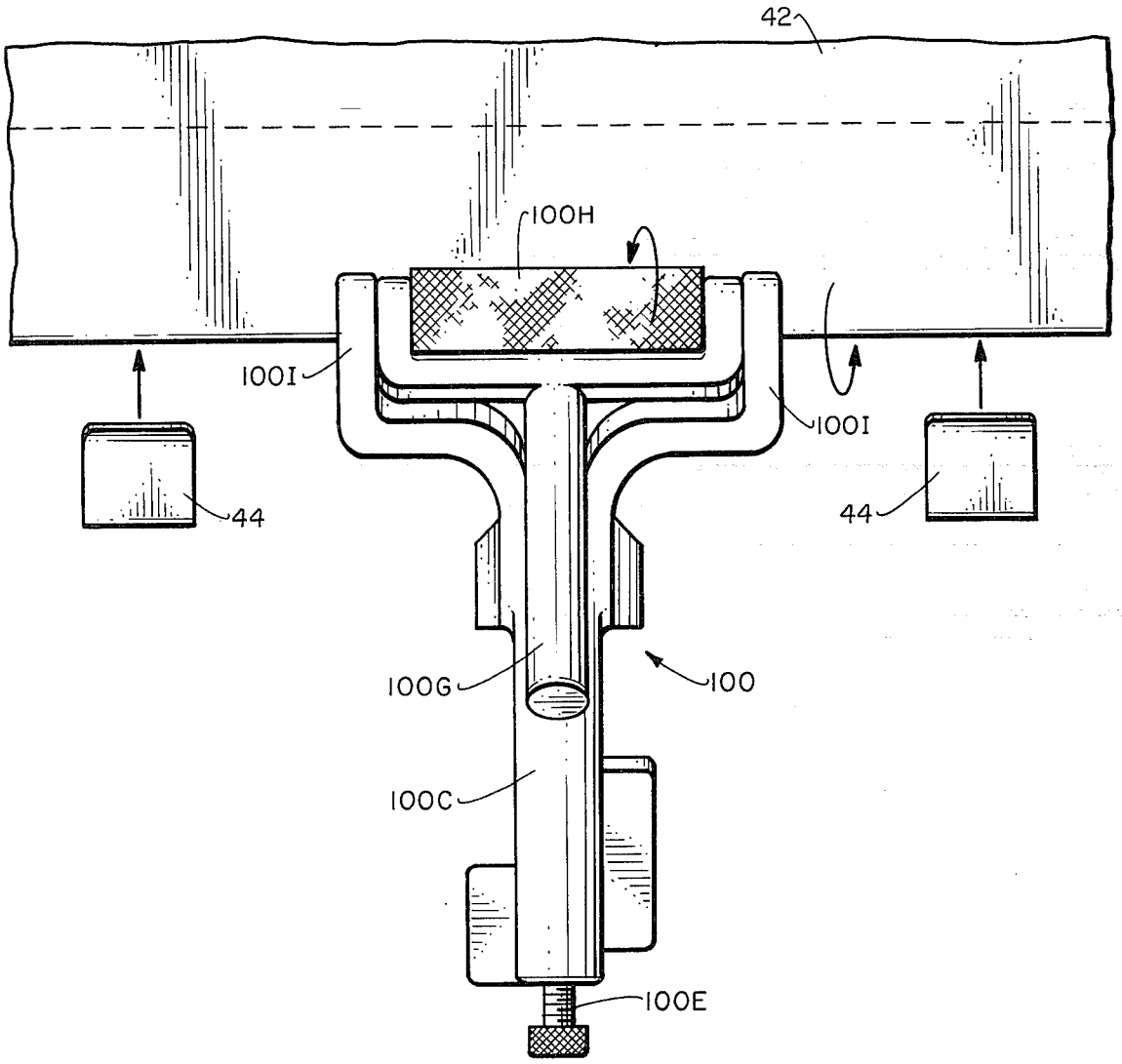
FIG. 14 is another view of the tool taken essentially along the line 14—14 of FIG. 13.

The flexible sign 42 is stretched between extrusions 22 and 40 of the right-hand display panel by means of a tool 100 illustrated in FIGS. 13 and 14. The face of the flexible sign material is printed with marks, such as shown by the broken line in FIG. 14, which are drawn to the margin of the frames of the display panel to indicate when exactly the correct tension has been achieved. Clips 44 are then snapped into place to hold the flexible sign material firmly and in a taut condition. These clips are configured to increase their gripping action as the tension of the flexible sign material increases so that the material is continuously restrained by the frame of the display panel and there is no distortion or scalloping of the indicia on the material, which often occurs, for example, when the prior art grommets are used.

Each clip 44 comprises, in cross-section, a relatively long arm 70, a bight 72, and a relatively short arm 74. As shown in FIG. 10, the angle between 70 and 72 is approximately a right angle, and that between 72 and 74 is an obtuse angle, to match the configuration of the corresponding cross-section of the member over which it is clipped. At the end of the arm 70 is an outturned lip 76, and at the end of the short arm 74 an inturned jaw 78. In application, after the flexible sign or sheet 42 (FIG. 13) has been drawn to the proper tension by the tool 100, clips 44 are applied on each side of the tool (FIG. 14). The jaw portion 78 is first inserted into the groove or indentation in the extruded beam member, and then the clip 44 is pivoted inwardly toward the center of the sign 42 into firm clamping position, as shown in FIGS. 9 and 10. The lip 76 facilitates both the application and removal of the clip 44.

The extrusions 22 and 40 forming the frame of the right-hand display panel need not have full structural strength for the complete tensioning of the flexible sign because of the angled construction of these extrusions which, as explained above, wedge into the correspondingly angled adjacent extrusions 20 and 33 when the panel is closed and locked.

The tool 100 has a jaw 100A which is operated by handles 100B, 100C. The handles are spring loaded by a spring 100D, and the movement of the jaw 100A is adjustable by a screw 100E which adjusts the angular position of a pivoted rod 100F. A handle 100G operates a ratchet reel 100H located at the end of an extension 100I of handle 100C.

In operation, the tool 100 is placed in the position shown in FIG. 13, and the handle 100G is operated to cause the ratchet wheel 100H to pull the sign material downwardly. The handles 100B, 100C are then squeezed to force the material up into the channel in the underside of the extrusion 38. When the marks on the sign 42 line up with the frame of the display panel to show that the proper tension has been reached, clips 44 are inserted to hold the sign in position. It should be pointed out that as a preliminary operation, the sign is clipped to the upper extrusion 21 by clips 44 with the marks on the sign lined up with the frame formed by extrusion 22.

Figure 15:
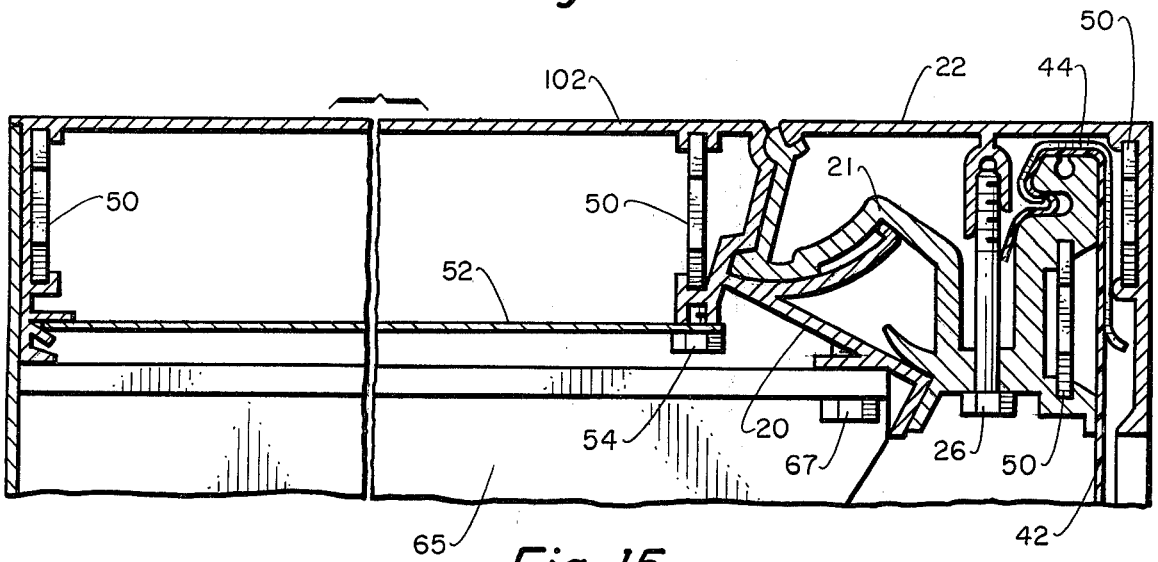
FIGS. 15 and 16 are fragmentary sections of the assembly, modified slightly to illustrate a further embodiment.
Figure 16:
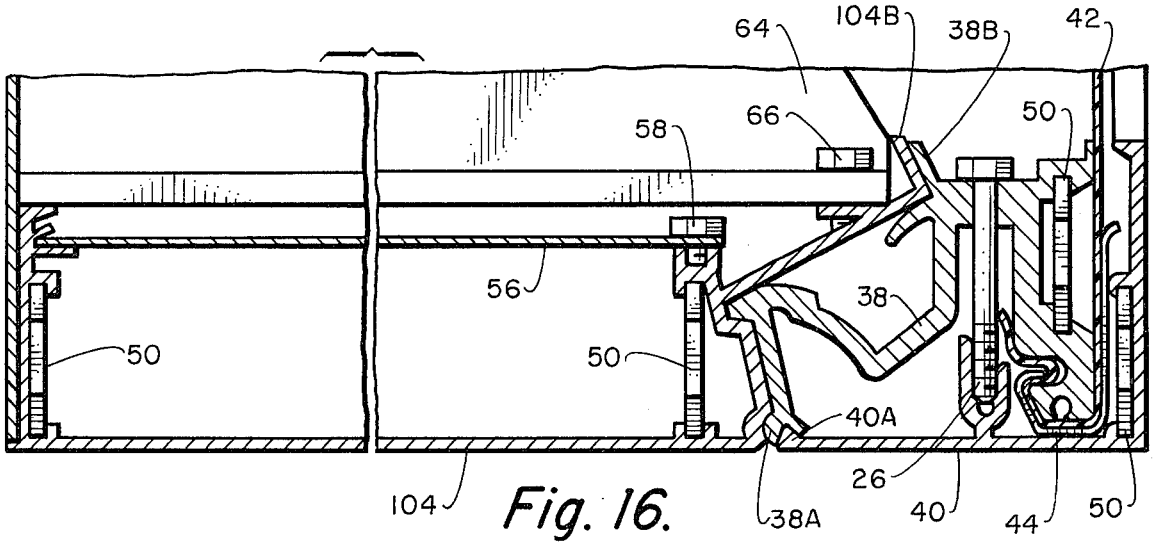

A modified construction is shown in FIG. 15 in which extrusions 10, 12, 14, 16, 18 and 20 of FIG. 3 are replaced by a single extrusion 102. Likewise, in the modified version of FIG. 16, extrusions 36, 39, 28, 30, 32 and 33 are replaced by a single extrusion 104.

The invention provides, therefore, an improved outdoor illuminated sign assembly which includes a housing formed of extrusions of aluminum, or other appropriate material, and which are held together in rigid coplanar relationship by internal fasteners. The assembly, as described, includes one or two display panels which, in turn, may support either a rigid sign or a flexible sign. In the case of the flexible sign, means are provided for tensioning the sign material within the frame of the display panel, and the construction is such that part of the stress is borne by the extrusions in the housing itself, so that the sign is held in a taut position, and has no tendency to sag or to become distorted. A further feature of the invention, as described above, is the fact that the display panels may be opened to a particular angular position for access into the interior of the housing, at which position the display panels are locked in the housing. Conversely, the display panels may be opened to another angular position, at which they may be withdrawn from the housing to facilitate, for example, the mounting of a new sign in the display panels.

It will be appreciated, of course, that although particular embodiments of the invention have been shown and described, modifications may be made. It is intended in the claims to cover all modifications which come within the true spirit and scope of the invention.

What is claimed is:

1. A sign assembly comprising a rectangular-shaped housing and at least one display panel hinged to one side of the housing;

said housing having a first elongate member extending across the upper edge of said side with a portion defining a longitudinal groove having an arcuate surface, and said first elongate member further having a longitudinally-arcuate concave portion coaxial with the axis of said groove surface; and said display panel having a second elongate member extending across the upper edge thereof with a portion defining a boss positioned and received in the groove of said first elongate member with an arcuate surface coaxial with said axis and mating with the arcuate surface of said groove, and said second elongate member having a longitudinally-extending arcuate convex portion coaxial with the axis of said boss and disposed in sliding relationship with said concave portion of said first elongate member.

2. The sign assembly defined in claim 1, in which said rectangular-shaped housing is formed of a plurality of elongate members secured to one another in side-by-side relationship to provide the top, bottom and ends for said housing; said top, bottom and ends each having a planar outer surface.

3. The sign assembly defined in claim 2, in which said purality of elongate members are secured to one another by mating portions formed on the interior surfaces thereof, and by interior screws extending into said mating portions.

4. The sign assembly defined in claim 1, in which said first elongate member includes a notch, and said second elongate member includes an edge which is received in said notch to lock the display panel in the housing when the display panel is turned to a closed position.

5. The sign assembly defined in claim 1, in which said arcuate concave portion of said first elongate member defines a lip, and said arcuate convex portion of said second elongate member defines a protuberance which is received in said lip so as to lock the display panel in the housing when the display panel is turned about the axis of said groove in said first elongate member from a closed position with respect to the housing to a maximum open position.

6. The sign assembly defined in claim 5, in which said first and second elongate members are shaped to permit the boss of said second elongate member to be lifted out of the groove of said first elongate member when the display panel is turned about the axis of the groove to an intermediate open position, so as to enable the display panel to be removed from the housing.

7. The sign assembly defined in claim 1, in which said housing has a third elongate member extending across the lower edge of said side, and said display panel has a fourth elongate member extending across the lower edge thereof; and latching means attached to said third and fourth elongate members for latching the display panel tightly to the housing when the display panel is in a closed position.

8. The sign assembly defined in claim 7, and which includes a display member mounted in said display panel and extending between the second and fourth elongate member.

9. The sign assembly defined in claim 8, in which the display member is formed of a translucent material, and which includes illuminating means for the display member mounted in the housing.

10. The sign assembly defined in claim 9, in which the display member is formed of a rigid material, and said display member is supported in slots in said second and fourth elongate members.

11. The sign assembly defined in claim 10, in which the upper end of the display member which is received in the slot in said second elongate member has an enlarged cross-section to enable the display member to be suspended from said second elongate member.

12. The sign assembly defined in claim 9 in which said display member is formed of a flexible material, and which includes a plurality of clips supporting the display member on said second and fourth elongate members in a taut condition.

13. The sign assembly defined in claim 12, in which said fourth elongate member has an indentation formed in the bottom edge thereof, and in which each of said clips is made of resilient sheet material and configured to embrace said fourth elongate frame member and having a first section paralleling a first side of said fourth elongate member, a second section paralleling a second side of said fourth elongate member, a third section paralleling the bottom of said fourth elongate member and a lip extending into said indentation.

14. The sign assembly defined in claim 8, in which said first, second, third and fourth elongate members each has a longitudinally extending angled portion, the angled portion of said second elongate member being received in wedged relationship with the angled portion of said first elongate member, and the angled portion of said fourth elongate member being received in wedged relationship with the angled portion of said third elongate member when the display panel is latched in its closed position by said latching means so that the first and third elongate members reinforce the second and fourth elongate members.

15. The sign assembly defined in claim 12, and which includes a tool for stretching the flexible display member across the second and fourth elongate member, said tool including a manually-operated ratchet wheel for stretching the flexible display member over a surface of one of the elongate members of said display panel, and manually operated jaws for retaining the ratchet wheel in contact with the surface of the display member and for feeding the end of the display member up into a channel formed in the underside of the last-named elongate member.

16. The assembly defined in claim 1, and which includes latching means for latching said hinged member to the structure, and in which said housing includes a third elongate member extending across the lower edge of said side, in which said display panel includes a fourth elongate member extending across the lower edge thereof, and in which each of said elongate members has a longitudinally-extending angled portion, the angled portion of said second elongate member being received in wedged relationship with the angled portion of said first elongate member, and the angled portion of said fourth elongate member being received in wedged relationship with the angled portion of said third elongate member when the hinged member is latched in its closed position by said latching means so that the first and third elongate members may reinforce the second and fourth elongate members.

17. A tool for stretching a flexible display member across a display panel, said panel having an elongate member at one edge thereof with a channel formed in the underside of said elongate member, said tool including a manually operated ratchet wheel for stretching the flexible display member over a surface of the elongate member, and manually operated jaws for maintaining the ratchet wheel in contact with the surface of the display member to hold the display member against said surface of said elongate member and for feeding the end of the flexible display member up into the channel in the underside of the elongate member.

18. Process of applying a flexible sheet of material over the face of a frame, comprising:

clipping one edge of the sheet to one side of the frame;

applying a friction tensioning tool to the sheet at the opposite side of the frame;

drawing the sheet taut across the face of the frame;

applying clips at each side of said tool to secure the opposite edge of the sheet to the opposite side of the frame.

19. Clip for holding the edge of a sheet of flexible material to a frame, comprising a generally U-shaped member formed of resilient sheet material, said member, viewed in cross-section, having a relatively long first arm, a bight, and a relatively short second arm, and outturned lip at the end of said first arm, and an inturned jaw at the end of said second arm.

20. A sign assembly comprising a rectangular-shaped housing and at least one display panel including an elongate member extending along the lower edge thereof with a longitudinal indentation formed along an inner face thereof;

a display member mounted in said display panel formed of flexible material;

a plurality of clips supporting the flexible display member on said display panel in a taut condition, each of said clips being made of resilient material and configured to embrace said elongate member, each said clip having a first section paralleling a first face of said elongate member, a second section paralleling a second face of said elongate member, a third section paralleling a third face of said elongate member, and a lip section extending into said indentation.

* * * * *